US005765520A

United States Patent [19]

Adachi et al.

[11] Patent Number: 5,765,520

[45] Date of Patent: Jun. 16, 1998

[54] CYLINDER HEAD FOR ENGINE

[75] Inventors: Shuhei Adachi; Junichi Inami, both of Iwata, Japan

[73] Assignee: Yamaha Hatsudoki Kabushiki Kaisha, Iwata, Japan

[21] Appl. No.: 672,536

[22] Filed: Jun. 28, 1996

[30] Foreign Application Priority Data

Jun. 28, 1995 [JP] Japan ..... 7-162693

[51] Int. Cl.[6] ..... F01L 3/02

[52] U.S. Cl. ..... 123/188.8; 123/193.5

[58] Field of Search ..... 123/188.8, 193.5

[56] References Cited

U.S. PATENT DOCUMENTS

| | | | |
|---|---|---|---|
| 4,217,875 | 8/1980 | Elsbett et al. | 123/188.8 |
| 4,438,740 | 3/1984 | Slee | 123/188.8 |
| 4,543,925 | 10/1985 | Ruf | 123/193.5 |
| 4,756,281 | 7/1988 | Chen et al. | 123/188.8 |
| 4,896,638 | 1/1990 | Shepley | 123/188.8 |
| 5,492,091 | 2/1996 | Russ | 123/188.8 |

FOREIGN PATENT DOCUMENTS

| | | |
|---|---|---|
| 0092683 | 11/1983 | European Pat. Off. . |
| 3331145 | 3/1985 | Germany . |

OTHER PUBLICATIONS

European Search Report dated October 1996. Patent Abstracts of Japan, vol. 014, No. 486 & JP-A-02 196117.

*Primary Examiner*—Erick R. Solis

*Attorney, Agent, or Firm*—Knobbe, Martens, Olson & bear LLP

[57] ABSTRACT

A cylinder head for a reciprocating machine such as an internal combustion engine wherein the valve seat inserts are metallurgically bonded to the cylinder head. The configuration of the inserts is such as to reduce unit stresses to resist creep deformation during engine operation. A number of embodiments are illustrated and described that achieve this result.

23 Claims, 13 Drawing Sheets

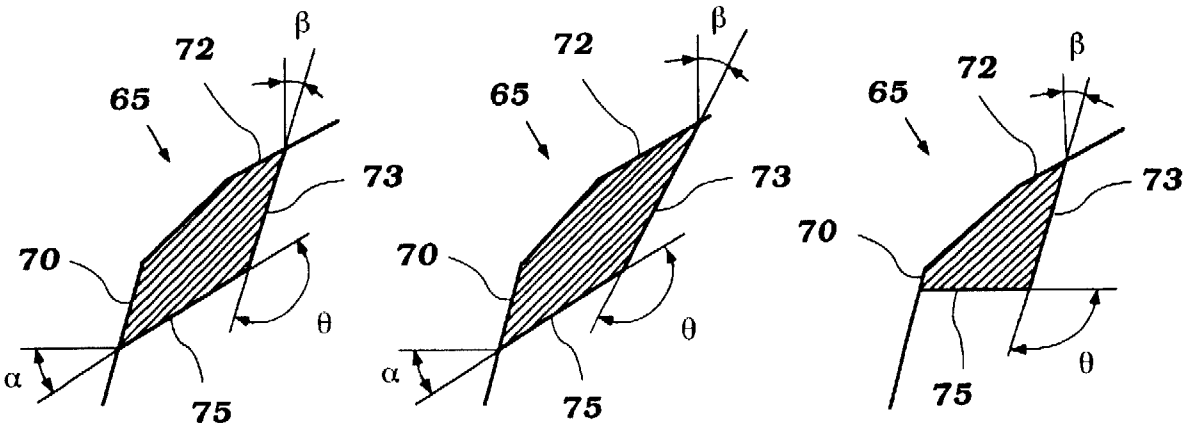
Figure 20 (A)
Figure 20 (B)
Figure 20 (C)
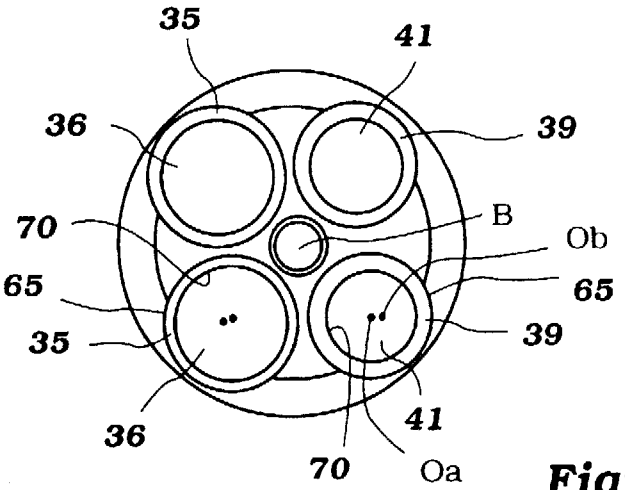
Figure 21

CYLINDER HEAD FOR ENGINE

BACKGROUND OF THE INVENTION

This invention relates to a cylinder head for a reciprocating machine and more particularly to an improved cylinder head for an internal combustion engine.

In many forms of reciprocating machines such as internal combustion engines, it frequently is the practice to employ aluminum or aluminum alloys as the material for a number of the major engine castings such as the cylinder heads. When the cylinder heads are formed from aluminum or aluminum alloys, however, certain components of the cylinder head are formed from a dissimilar material so as to improve performance. For example, the valve seats of the cylinder head are normally formed from a harder, less heat conductive material such as iron or ferrous iron alloys. By utilizing such harder materials, the valve seat life can be extended. However, the attachment of the dissimilar valve seat insert into the cylinder head presents a number of problems.

Conventionally, it has been the practice to form the cylinder head passages with recesses adjacent the seating area, into which the insert rings which form the valve seat are press fit. The use of press fitting has a number of disadvantages. These disadvantages may be understood by reference to FIG. 1 which shows a conventional pressed in type of valve seat.

The cylinder head material 21 is formed with a counterbore 22 at the cylinder head recess side of the flow passage 23. The flow passage 23 may be either an intake passage or an exhaust passage. The insert ring is indicated by the reference numeral 24 and may be formed from any suitable material, such as a Sintered ferrous material. Such materials have the advantage of having high wear capabilities. After the insert 24 has been pressed into place, its surface is machined as at 25 so as to form the actual valve seating surface.

As may be seen, this technique requires relatively large valve seat inserts in order to withstand the pressing pressures. In addition, the press fit must be such that the insert ring will not fall out when the engine is running. As a result, there are quite high stresses exerted both on the cylinder head and on the insert ring. The stresses can result in loads which may eventually cause cracks in the cylinder head.

These types of construction also limit the maximum size and spacing of the valve seats in order to ensure adequate cylinder head material between adjacent valve seats to reduce the likelihood of cracking. In addition, the large seats compromise the configuration of the intake passages, particularly at the critical valve seating area. Finally, these constructions result in somewhat poor heat transfer from the valve to the cylinder head due to the poor thermal conductivity of the valve seat material and the poor contact area between the insert 24 and the cylinder head 21.

In addition, the interface between the insert ring and the cylinder head frequently leaves voids or air gaps which further reduce the heat transfer and thus cause the valves to run at a higher temperature. This higher temperature operation of the valves requires the valves to be made heavier and stronger and thus reduce the performance of the engine and increase its size and costs.

Many of these problems become worse as the engine reaches operating or higher temperatures. Because of the higher coefficient of expansion of the cylinder head material, the press fit force diminishes and the contact area for heat transfer also decreases.

It has been proposed, therefore, to utilize a technology wherein the insert ring is laser clad into the cylinder head. Such a cylinder head assembly is shown in FIG. 2. In this technique, a somewhat smaller insert ring 26 is laser clad into the cylinder head material 21. This results in a bonding interface 27 that is formed between melt reaction layers 28 and 29 of the cylinder head material 21 and insert ring material 26. These actually form alloys.

Such laser cladding generally ensures against the likelihood of stresses which may cause cracking. Nevertheless, the laser cladding technique itself requires rather large inserts and thus a number of the disadvantages with pressed in inserts also are found with welded inserts. Furthermore, the heat transfer problems are also prevalent and in some instances can become worsened.

With a laser cladding technique, there is actually formed a metallurgical alloy between the material of the insert ring and the cylinder head. Because of the fusion process, air pockets or voids may occur in the areas 28 and 29 and heat transfer is reduced. In addition, the alloy at the interface between the insert ring and the cylinder head also has poor thermal conductivity and thus a number of the problems present with pressed in inserts are also present with laser clad inserts.

It has been proposed, therefore, to employ a technique wherein the insert ring is metallurgically bonded but not alloyed to the cylinder head material. This is accomplished by pressing the insert into place and passing an electrical current through the insert which is sufficient to cause the cylinder head material to plastically deform upon insertion of the insert ring. The plastically deformed phase of the cylinder head material forms a metallurgical bond at the interface with the insert ring without any significant resulting alloying of the cylinder head material to that of the insert ring. Such an arrangement is disclosed in our co-pending application entitled, "Method of Bonding Valve Seat" Application No., 08/636,011, filed Apr. 22, 1996 and assigned to the assignee hereof. This technique has a number of advantages over the conventional structures. First, it permits the use of much smaller insert rings since the pressing pressure is reduced and thus the shape of the intake passage, particularly the shape of the cylinder head passages, particularly in the critical area of the valve seats is not compromised. In addition, the bond strength is considerably higher than more conventional methods. Furthermore, this technique, because of the improved way in which the adhesion is formed, permits the use of much smaller insert rings and thus permits the valve seat openings to be positioned closer to each other without the likelihood of causing defects in the cylinder head which may manifest themselves during the engine running and life.

Because of the use of this technique, it is also possible to optimize certain relationships between the valve seat insert, the valve, between the inserts for the intake and exhaust valves to suit their particular applications, and also to appropriately configure the valve seat insert relative to the controlling valve so as to optimize cooling and cylinder head configuration.

For example, even though the bond is much better than the adhesion with prior art methods, certain conditions may occur during engine running that can deteriorate the valve and valve seat relationship. For example, the aluminum alloy of the base cylinder head casting or other alloys that may be utilized for this purpose, are subject to repeated impact loading by the contact of the harder insert rings with the valves during their opening and closing. As a result, the pounding of the valve against the insert ring can cause the insert ring to actually deform into the cylinder head during engine operation over extended periods. This is particularly true when the engine is operated in an elevated temperature, as is generally true, particularly when associated with the exhaust valves.

It is, therefore, a principal object of this invention to provide an improved bonded valve seat construction wherein the insert ring is configured relative to the valve head so as to minimize the effects of wear and pounding in of the insert ring during continued and extended engine operation.

It is a further object of this invention to provide an improved configuration for a bonded insert ring and the associated cylinder head and valve wherein the optimum life expectancy can be obtained without sacrificing the maximum valve flow areas.

Because of this possibility of pounding in of the insert and in an effort to reduce the stresses and likelihood of the same, it might be possible to increase the size of the insert ring and particularly its diametral thickness so as to reduce the likelihood of pounding in. However, this type of configuration particularly in relation to the size of the head of the valve can adversely effect the flow area into and out of the combustion chamber.

It is, therefore, a still further object of this invention to provide an improved valve seat insert configuration and size for a bonded valve seat wherein the flow areas will be optimized while minimizing the likelihood of pounding in of the inserts.

The same characteristics as aforenoted differ for intake valves relative to exhaust valves. However, it is generally the practice to utilize a substantially same configuration and dimensional relationships for both the intake and exhaust valve seat inserts. As a result, the configuration is not optimized, bearing in mind the different loading and characteristics to which the respective insert rings are subjected.

It is, therefore, a still further object of this invention to provide an improved bonded valve seat arrangement for the cylinder head of an engine wherein each of the exhaust and intake valve seats is appropriately sized for its respective loading and wear conditions.

With most conventional valve seat techniques, the flow passage through the valve seat insert is generally symmetrically arranged to the outer periphery of the insert. This is done for a variety of purposes and is generally necessary with the prior art type of constructions. However, it has been discovered that the cooperation of the insert ring with the cylinder head can be significantly improved if an asymmetric relationship can be employed. The use of this bonding technique facilitates this arrangement.

For example, because of the different thermal loadings and to maintain uniform temperatures as much as possible across the cylinder head surfaces, it may be desirable to extend the valve seat insert ring for a substantial distance beyond the valve head in one area of the cylinder head. In addition, it may be desirable to otherwise configure the valve seat relative to its flow passage to improve performance.

It is, therefore, a still further object of this invention to provide an improved cylinder head construction embodying a bonded valve seat and wherein the insert ring is asymmetric relative to the flow path which it defines.

SUMMARY OF THE INVENTION

A first feature of this invention is adapted to be embodied in a cylinder head for a reciprocating machine that comprises a base cylinder head member formed from a light metal alloy and having a flow passage extending from a portion of the base cylinder head member that cooperates with a cylinder bore for forming a variable volume chamber. A valve seat insert is metallurgically bonded to the base cylinder head member at the variable volume chamber end of the flow passage. The valve seat insert is formed from a material harder than that of the base cylinder head material and which forms a valve seat surface. A poppet-type valve is supported for reciprocation relative to the valve seat surface for opening and closing the flow through the flow passage.

In accordance with this feature of the invention, the following relationship holds true:

$$D<D_0<D+5$$

where $D_0$ is the outside diameter of the valve seat insert and D is the outside diameter of the head of the poppet valve. All dimensions are in millimeters.

Another feature of the invention is adapted to be embodied in a cylinder head for a reciprocating machine that comprises a base cylinder head member formed from a light metal alloy and having a flow passage extending from a surface of the base cylinder head member that cooperates with a cylinder bore for forming a variable volume chamber. A valve seat insert is metallurgically bonded to the base cylinder head member at the variable volume chamber end of the flow passage. The valve seat insert is formed from a material harder than that of the base cylinder head material and which forms a valve seat surface. A poppet-type valve is supported for reciprocation relative to the valve seat surface for opening and closing the flow through the flow passage. In accordance with this feature of the invention, the flow passage defined by the valve seat insert is asymmetrically disposed relative to the outer peripheral edge of the valve seat insert.

A still further feature of the invention is adapted to be embodied in a cylinder head for an internal combustion engine. The cylinder head is comprised of a base cylinder head body formed from a lightweight metal alloy. Intake and exhaust flow passages extend through the base cylinder head body from a surface thereof that cooperates with a cylinder bore to form a combustion chamber. Intake and exhaust valve insert rings are bonded into the intake and exhaust passages on the surface that forms the combustion chamber. These insert rings are formed from a harder metallic material than the base cylinder head material and are metallurgically bonded thereto. In accordance with this feature of the invention, the dimensional relationship of the exhaust insert ring is different from that of the intake insert ring so as to provide improved characteristics demanded by the higher temperature which the exhaust side experiences.

The three views of FIG. 20 illustrate various cross-sectional shapes that may be utilized in conjunction with the valve seat insert rings.

Figure 13:
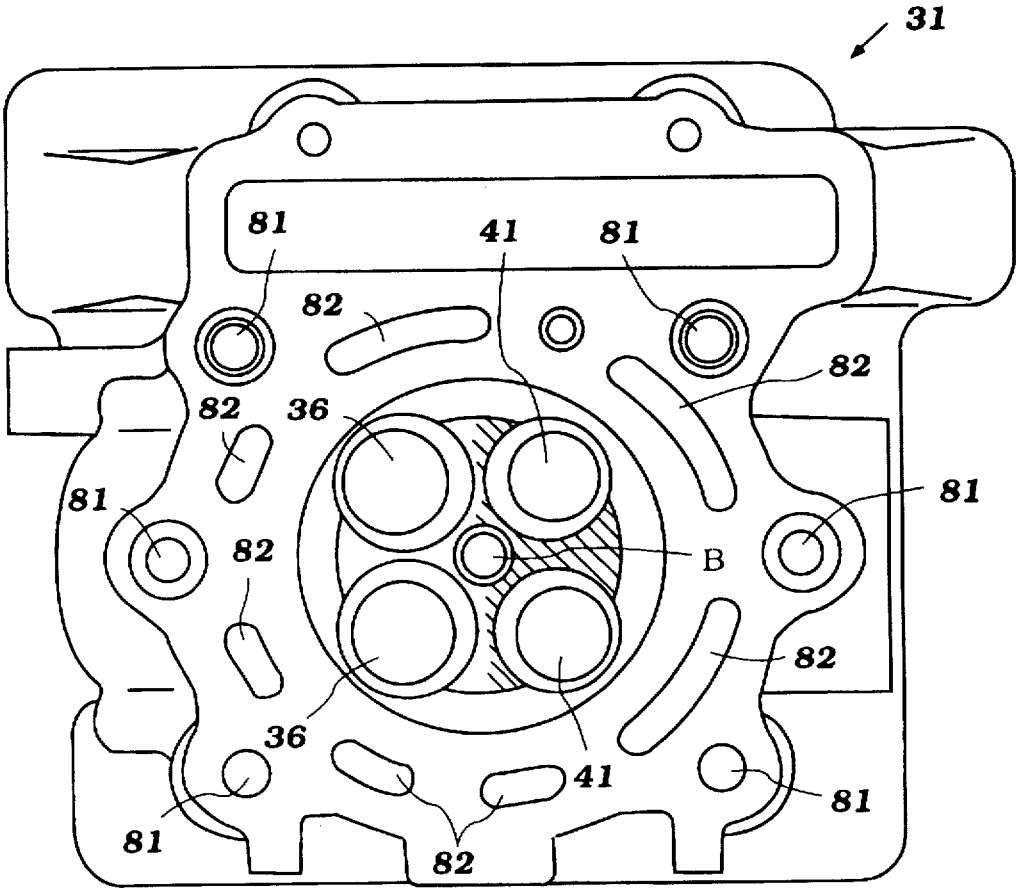
FIG. 13 is a bottom plan view showing the cylinder head and illustrating how the conditions are different on the exhaust side relative to the intake side.
Figure 19:
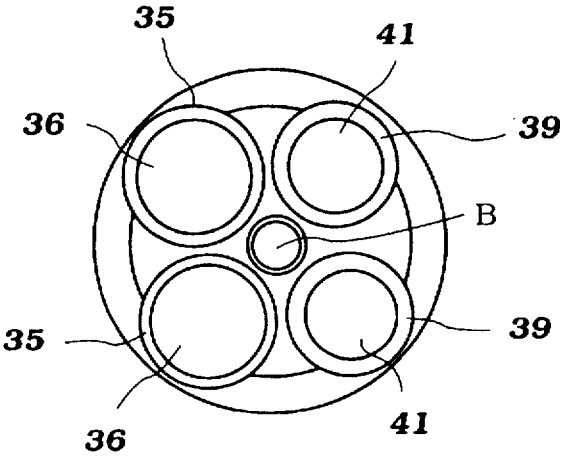
FIG. 19 is a partial bottom plan view, in part similar to FIG. 13 and is utilized to explain other features of the invention.

FIG. 21 is a view of the cylinder head recess, in part similar to FIGS. 13 and 19 and explains a further feature of the invention.

Figure 22:
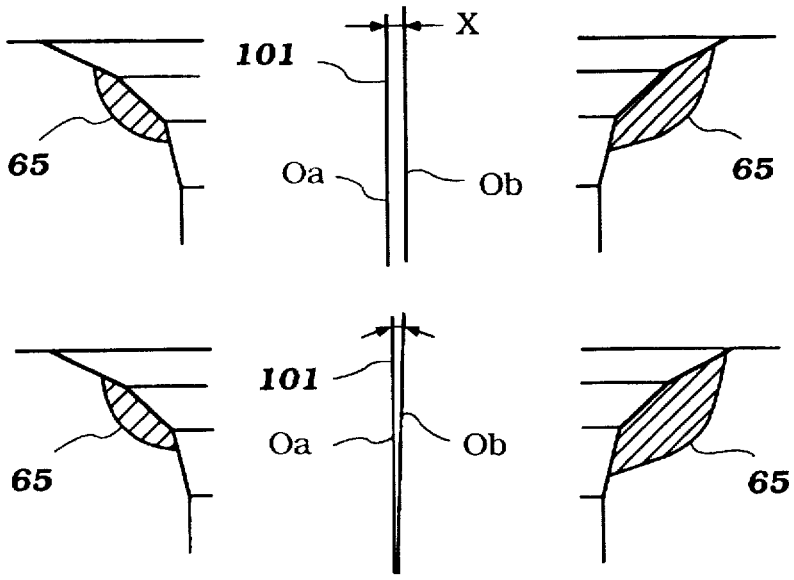

FIG. 22 is a series of cross sectional views taken through the valve seats in FIG. 21.

Figure 23:
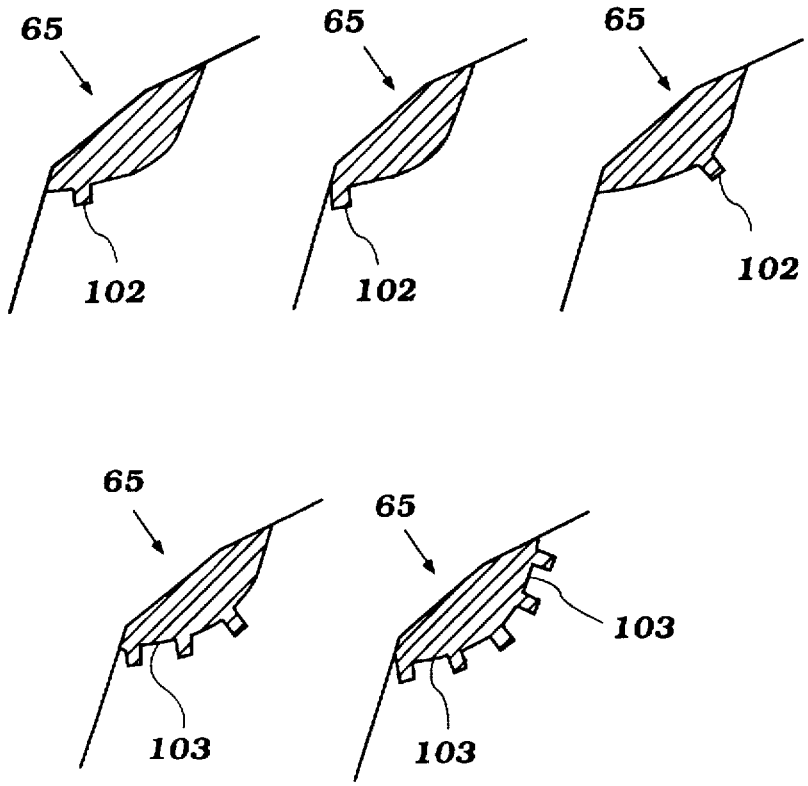

FIG. 23 is a series of cross-sectional views showing further configurations that may be utilized in conjunction with the insert ring and its bonded configuration.

Figure 24:
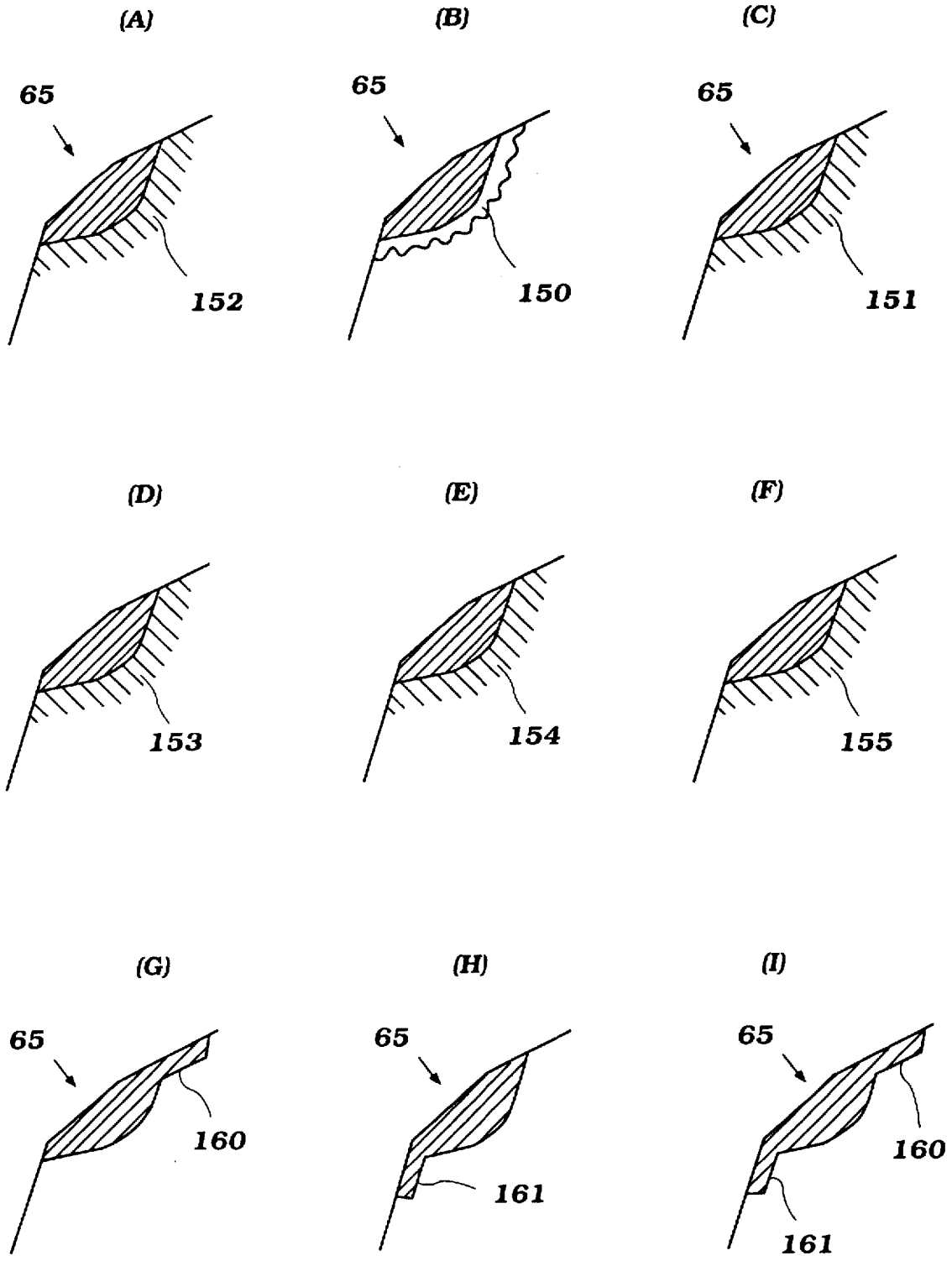

FIG. 24 is a further series of cross-sectional views, in part similar to FIG. 24 and shows other configurations of insert rings and associated cylinder head surfaces that can be utilized in conjunction with the invention.

DETAILED DESCRIPTION OF THE PREFERRED EMBODIMENTS OF THE INVENTION

It should be noted that the actual mechanical way in which the bond is formed with the valve seat is as described in the aforenoted co-pending application, the disclosure of which are incorporated herein by reference. Even though this disclosure is incorporated herein by reference and the invention in this application deals primarily with the resulting cylinder head and particularly to the configuration of the insert rings and their relation to each other and to the cylinder head base material, a general description of the bonding process will also be included. However, where further information is required, reference may be had to the aforenoted co-pending application.

Figure 1:
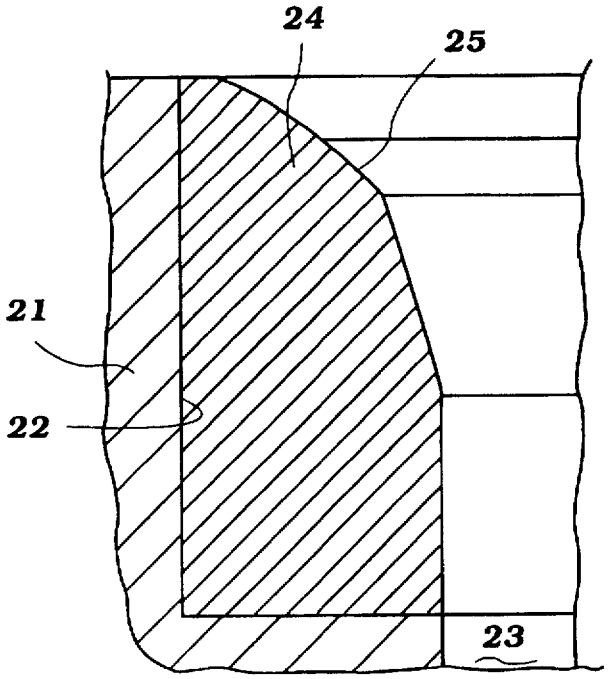
Figure 1 Prior Art
FIG. 1 is an enlarged cross-sectional view taken through a conventional prior art-type pressed in valve seat.
Figure 2:
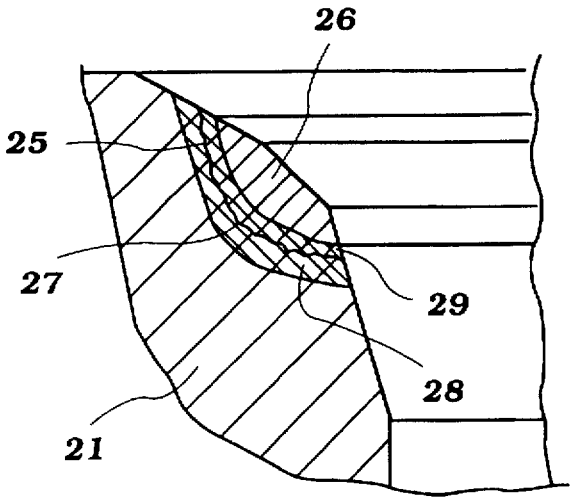
Figure 2 Prior Art
FIG. 2 is an enlarged cross-section view, in part similar to FIG. 1, and shows a conventional laser clad type valve seat.
Figure 3:
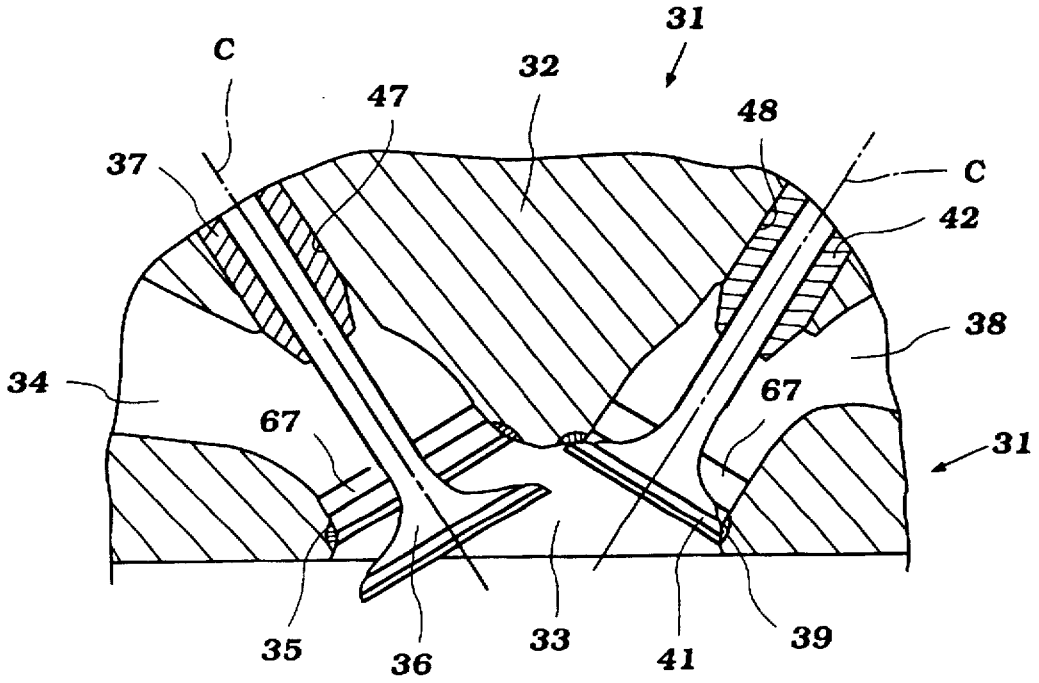
FIG. 3 is a partial cross-sectional view taken through a cylinder head having valve seats formed and constructed in accordance with the invention.

Referring first to FIG. 3, a cylinder head for an internal combustion engine utilizing the invention is identified generally by the reference numeral 31. The cylinder head includes a base cylinder head casting 32 which is formed from an aluminum or aluminum alloy. Such materials are highly desirable for use in engine components and particularly cylinder heads because of their light weight and high thermal conductivity and specific, preferred materials will be disclosed later herein.

The cylinder head 32 is formed with combustion chamber recesses 33 which cooperate with the associated cylinder bore and piston (both of which are not shown) of the associated engine to form its combustion chambers. An intake charge is delivered to these combustion chambers through one or more intake passages 34 that are formed in the cylinder head material 32 and which terminate at valve seat 35 within the cylinder head recess 33. Poppet type intake valves 36 are supported within the cylinder head 32 by valve guides 37 for controlling the opening and closing of the valve seats 35 in a well known manner. The intake valves 36 may be operated by any known type of valve actuating mechanism.

One or more exhaust passages 38 extend from the cylinder head recesses 33 and specifically from valve seats 39 formed therein for the discharge of the combustion products from the combustion recesses 33 in a manner also well known in this art. Exhaust valves 41 are slidably supported in the cylinder head 32 by valve guides 42. These exhaust valves 41, like the intake valves 36 are operated by any known type of mechanism.

Figure 4:
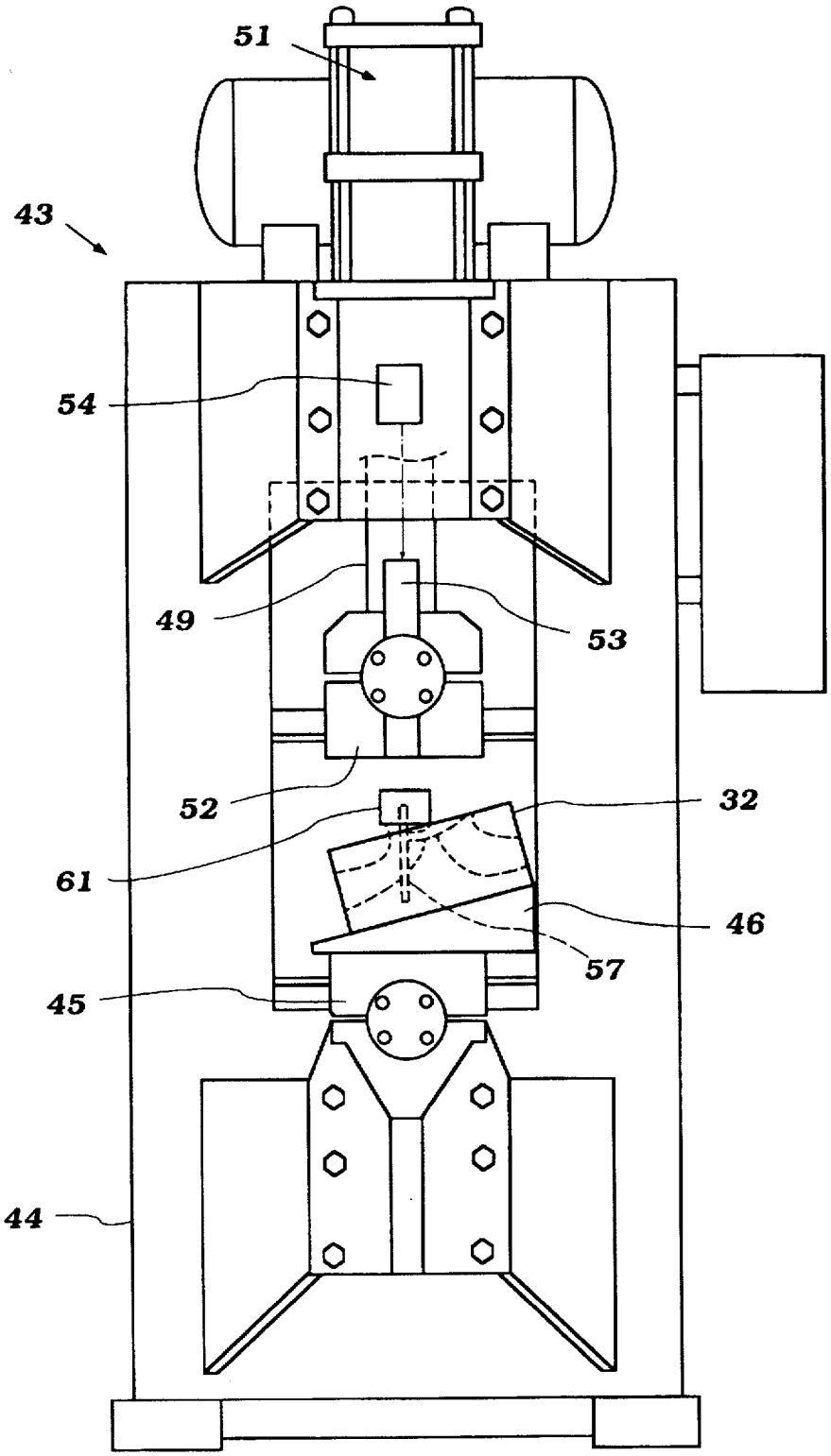
FIG. 4 is a front elevational view of an apparatus for making bonded valve seats.
Figure 5:
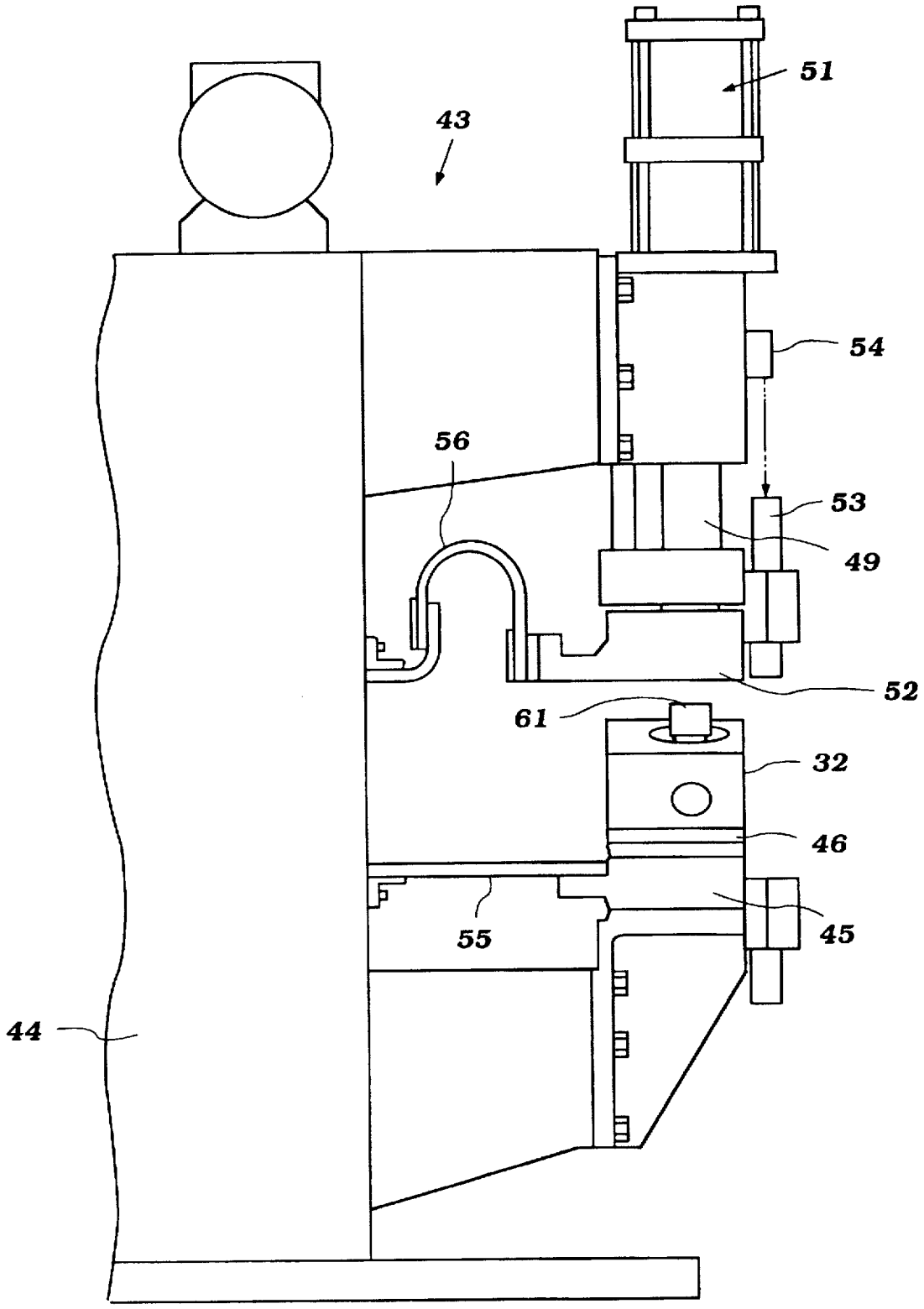
FIG. 5 is a side elevational view of the apparatus.

The invention, as should be readily apparent from the foregoing description, deals in the configuration of the valve seats 35 and 39 and their relationship to their associated valves 36 and 41 and to each other. The apparatus by which the resulting valve seats are formed is shown best in FIGS. 4–6 and will be discussed and described by reference to these figures.

The apparatus is indicated generally by the reference numeral 43 and may be considered to be similar to a pressure welding apparatus. However, and as will become apparent, the actual electrical current flow is not sufficient to cause any welding of the insert rings to the cylinder head material.

The apparatus 43 is comprised of a press base 44 that has a support element 45 on which a fixture 46 is mounted so as to accommodate the cylinder head 32. The fixture 46 is disposed so that the cylinder head 32 will be held at an angle. This angle is such that one of bores 47 or 48 (FIG. 3) that received the valve guides 37 or 42 will be in line with the pressing axis of the equipment.

Supported above the table or base 45 is a ram 49 which is driven by a hydraulic or pneumatic motor 51. The ram 49 carries a pressing electrode member, indicated generally by the reference numeral 52.

Affixed to the pressing electrode member 52 is an adjustable post 53 which cooperates with a proximity sensor or detector 54 such as a laser which is utilized to determine the degree of movement during the pressing of the inserts in place and the degree of movement of the ram 49 specifically. The output of this detector 54 indicates the depth at which the insert is pressed into the cylinder head, as will become apparent.

The base 44 carries a source of high energy electricity that is transmitted to the base plate 45 through a first conductor 55 and to the pressing member 52 through a second conductor 56. The conductors 55 and 56 will accommodate vertical movement and the conductor 56 is so configured in this embodiment. The pressing electrode 52 is preferably charged positively and the support base 45 is negatively charged.

The actual pressing apparatus and its association with the cylinder head will now be described by reference FIG. 6. As seen in this figure, a mandrel post, indicated generally by the reference numeral 57, is placed into the valve guide opening 47 of the cylinder head 32. The mandrel post 57 is formed from a central post part 58 that is formed from a suitable material, such as a metallic rod. However, in order to provide electrical insulation, for a reason which will become apparent, the rod 58 is provided with an insulating coating 59. Although the insulating coating 59 may be of any material, a ceramic material, such as alumina, is preferred. The alumina coating 59 is flame sprayed onto the rod base 58 and then is finished by polishing.

A stopper ring 60 is affixed to the mandrel 57 and contacts the inner surface of the cylinder head intake passage 34 around the valve guide opening 47 so as to limit how far the mandrel post 57 extends into the valve guide opening 47.

A further pressing member, indicated generally by the reference numeral 61, is provided with an opening 62 complementary in shape to the mandrel and is slid thereover. The pressing member 61 has an actual pressing surface that is formed by a hardened body 63 formed from an appropriate material and which either is magnetized or which carries a magnetic body 64 so as to attract and hold an insert ring 65 thereupon. The body surface 63 is formed with a tapered end 66 that is complementary to the shape of the insert ring 65, as will be described later by reference to FIG. 7. Because the pressing body 61 is engaged the electrode 52, electrical current will flow through the pressing body 61 and through the insert ring 65. As will become apparent later, when the insert ring 65 is engaged with the cylinder head 32, an electrical path will be formed through the cylinder head and base 45 to the conductor 55 to complete the electrical path. The insulated coating 59 on the mandrel 57 prevents short-circuiting around this area.

Figure 7:
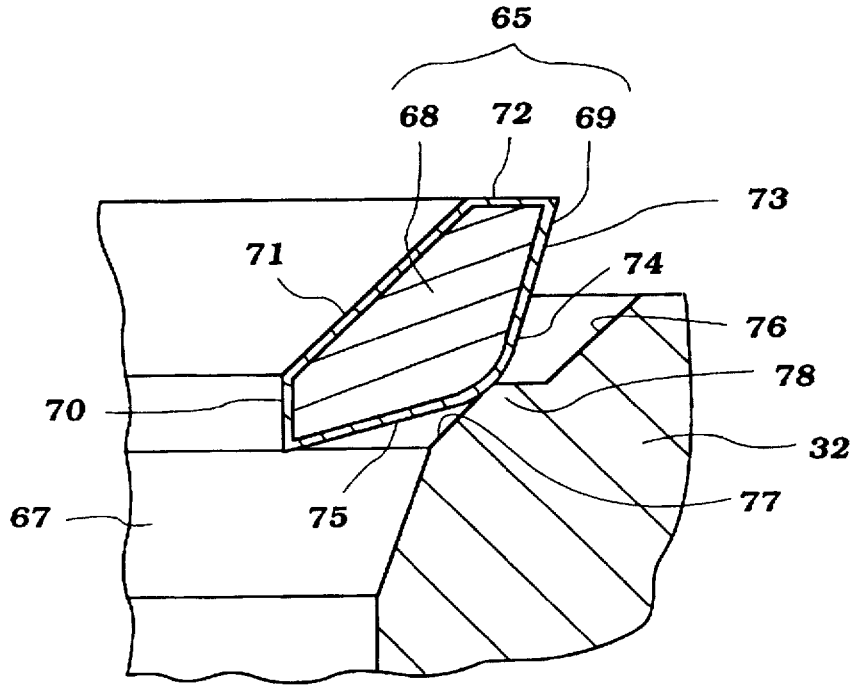
FIGS. 7–11 are step-by-step cross-sectional views showing the steps in pressing in and bonding a valve seat insert in accordance with the invention with FIG. 7 showing the initial step and FIG. 11 showing the final machined valve seat.

The construction of the insert ring 65, its shape and the shape of a cooperating recess 67 formed in the cylinder head at the mouth of the intake passage 34 will now be described by primary reference initially to FIG. 7. FIG. 7 is an enlarged cross-sectional view of one of the intake valve seats 35 and this description may be considered to be typical for that which may be utilized with the exhaust valves 41 to form the exhaust valve seats 39.

Basically, the valve seat 35 is formed by the insert ring, indicated by the reference numeral 65 and which has a metallurgical construction as will be described. This insert ring 65 is bonded to the cylinder head material 32 by a relatively thin metallurgical bonding layer that is formed in a manner which will be described. Adjacent this bonding layer, there is formed a portion of the material of the cylinder head 32 which has been plastically deformed. It should be noted that the alloy of the cylinder head 32 is of the same chemical composition and same physical structure, except for being slightly work hardened in the area adjacent the bonding layer, as in the remainder of the cylinder head material 32.

The insert ring 65, is formed from a Sintered ferrous alloy base 68 having a coating material filled within its intercices and also on its external surface as desired, which coating is indicated at 69. This material is preferably formed from a good electrical conductor such as copper. Copper also has another useful function as a coating for a reason to be described.

The insert ring 65 in accordance with this embodiment is formed with a cylindrical inner surface 70 that is relatively short in axial length and which merges into a tapered conical surface 71 which extends for a substantially length. The surface 71, which is actually the pressing surface, as will be described, ends in an end surface 72.

A first, conical outer surface section 73 extends at an acute angle to the axis of the cylindrical section 70 and merges at a rounded section 74 into an inclined lower end surface 75 which is formed at a greater angle than that of the conical surface 73. However, this angle is still an acute angle to a plane perpendicular to the axis of the cylindrical section 70.

The cylinder head material 32 is formed with a recess that is comprised of a first section 76 that is connected to a second section 77 that are joined by a horizontal surface that forms a projecting ledge 78 that contacts the rounded portion 74 of the insert ring 65 upon initial installation (FIG. 7). This tends to form a localized area that will begin the plastic deformation phase.

It has been noted that the copper coating serves the function of improving the electrical conductivity of the insert ring 65. Also, it has been noted that the copper performs additional functions. As should be apparent from the foregoing description, it is important that the bonding process not result in any alloying of the insert ring material and specifically that of the base 68 with the base material of the cylinder head 32.

The copper also serves the function of forming a eutectic alloy with the material of the cylinder head 32 which eutectic alloy has a lower melting point than either the melting point of the copper or that of the cylinder head material. As a result, the plastic deformation is accomplished with added ease and the metal can flow out during the pressing process as will be noted without large heat generation. In addition, the copper will react with any aluminum oxides that may be present on the surface of the recess 67 of the cylinder head 32 so as to extrude these oxides and provide a purer finish.

Preferably, the copper plating is done by electroplating and has a thickness in he range of 0.1–30 μm. Also, the cylinder head material of the body 32 is preferably an aluminum, silicon, magnesium alloy as set forth in Japanese Industrial Standard (JIS) AC4C.

Figure 6:
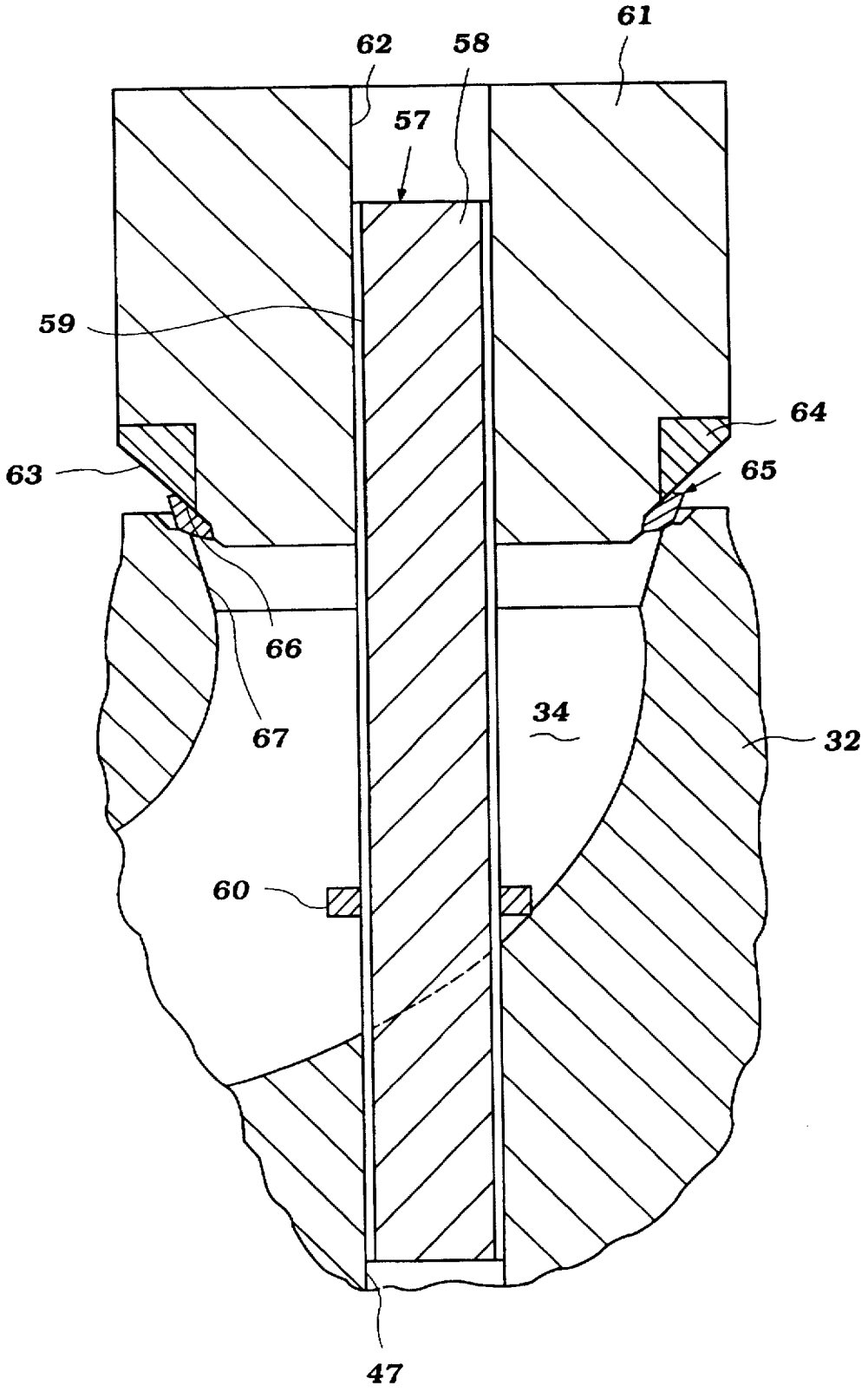
FIG. 6 is an enlarged cross-sectional view showing the apparatus in position for forming the bonded valve seat.

Beginning now to describe the pressing operation by reference to FIGS. 7–11, FIG. 7 shows the conditions comparable to that in FIG. 6. The pressing force is then applied by actuating the hydraulic ram operating motor 51 so as to move the electrode 52 into contact with the pressing mandrel electrode 59. Prior to this the mandrel 59 may be rotated to ensure that the insert ring 65 is correctly seated.

Figure 12:
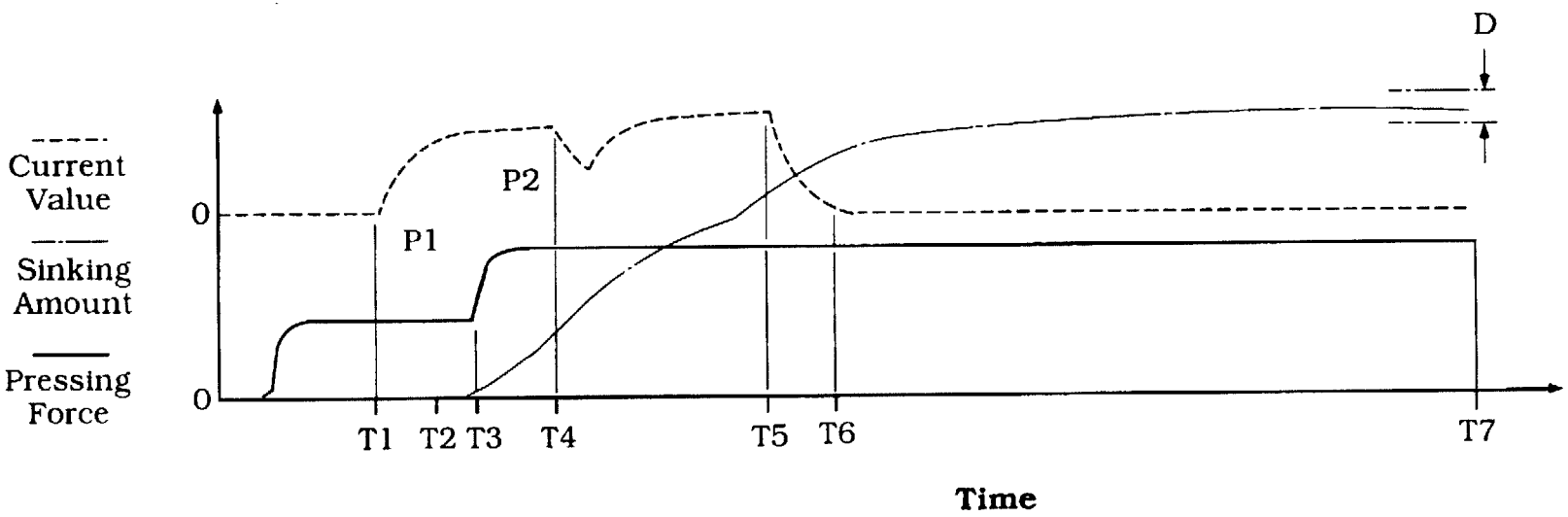
FIG. 12 is a graphical view showing pressing force and electric current flow in accordance with a preferred method of practicing the invention to achieve a bonded valve seat.

A pressing force is then applied at a force indicated at the force P1 in FIG. 12. This force acts along the center axis of the seat and is maintained up until the time T1 wherein an electric current flow through the joint is initiated. When this occurs, there will be a high electrical resistance due to the small contact area and a plastic deformation begins in the range indicated at A in FIG. 8 so as to displace the material of the cylinder head 32.

Figure 8:
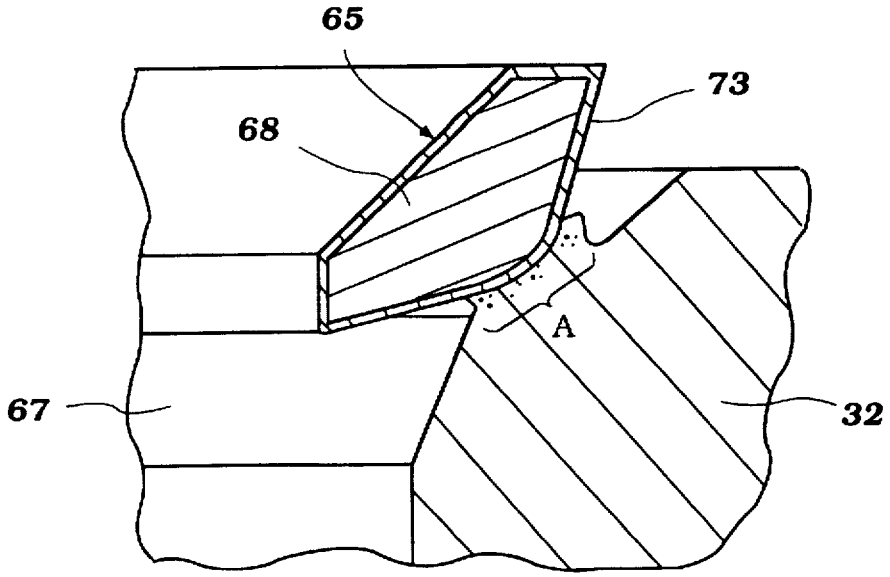

As the current is built up, the material will reach a temperature wherein the internal resistance is high enough to cause the copper coating layer 74 to defuse into the cylinder head material in the area 78 or shown in the range A so as to form the eutectic alloy that results in the area indicated at A in FIG. 8 and which eventually causes displacement and a plastic deformation and the valve insert ring 65 will begin to become embedded in the material of the cylinder head 32.

Figure 9:
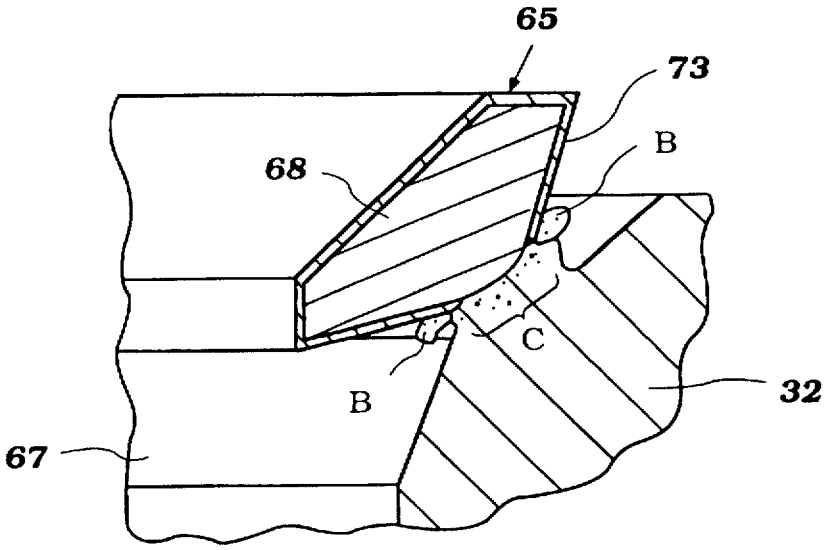

The eutectic layer is displaced as indicated at B in FIG. 9 toward the area which will be removed from where the final valve seat will be formed. Said another way, this material will be later machined away.

The actual deformation of the insert into the cylinder head body, as measured by the sensor 54, begins at the point in time T2. At some time thereafter, the electric current will have reached its maximum amount at the first level at the point T3 and then the pressing pressure is increased from the pressure P1 to a new higher pressure P2 which is then held.

This plastic deformation then continues and after a certain deflection and at the time period T4, the electric current is reduced sharply toward zero as shown in FIG. 12. This is done to avoid overheating and to ensure that there will be no alloying of the insert ring material and that of the cylinder head material. There will, however be atomic diffusion of the materials in the area C.

Figure 10:
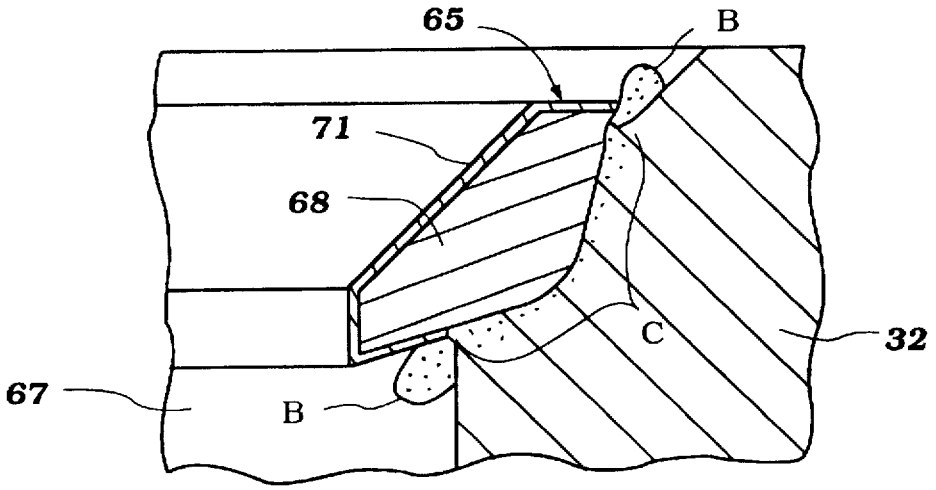

The electric current is then built up higher to a new level equal to or slightly higher than that before and is held at this level until the point in time T5. This pressing is continued after this still at the pressure P2 during which time period the current flow is dropped back to zero at the time period T6 while pressing is continued. The final joint appears as shown in FIG. 10 and it will be seen that substantially all of the eutectic alloy has been pushed from the area between the insert base 67 and the base cylinder head material resulting in only the work hardened adjacent the joint and atomic bonding in the area C. In addition, the metallurgical bonding will be completed.

During this time and after the completed bonding, the apparatus measures the amount of actual embedding of the insert ring 65 into the cylinder head 32. There is an allowable range as indicated by the dimension D in FIG. 12 which range is about 0.5 millimeters to 2 millimeters and preferably in the range of 1 to 1½ millimeters. If the sinking level is not reached in this range, then it can be assumed that the joint is not satisfactory. This judgment may also be made during the actual pressing, bonding operation. If the deflection is not in the proper range, the process may be discontinued.

Figure 11:
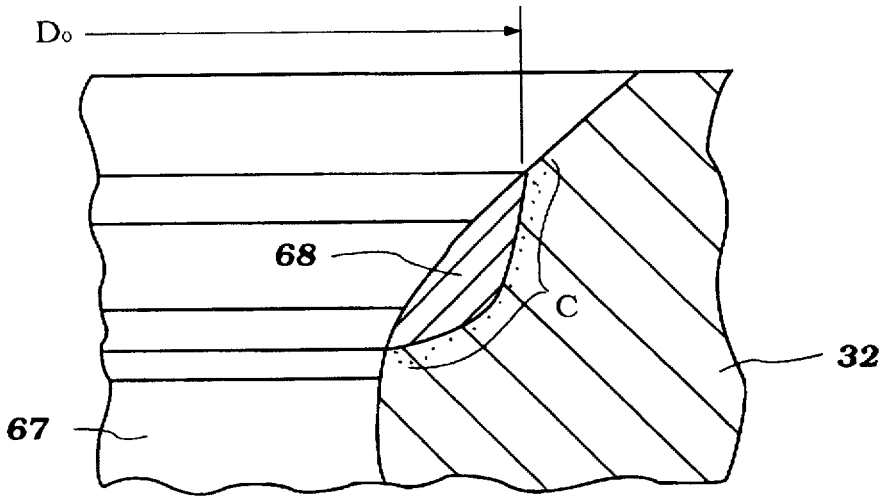

The heads are finish machined by grinding or the like to the conditions shown in FIG. 11. Thus, it will be seen that all of the eutectic alloy phase B is removed and only the metallurgical bonding area C remains. The finished joint has no melt reaction layer or no actual alloying between the cylinder head material and that of the insert ring.

Having thus described the characteristics of the manner in which the valve seat inserts are bonded into place, the physical characteristics of the insert rings that provide the advantages of this invention will now be described by primary reference to FIGS. 13–25. Referring first to FIG. 13, this is a bottom plan view of the cylinder head and depicts the condition when the engine is running. This figure also shows the openings 81 in the cylinder head that receive the threaded fasteners for affixing the cylinder head 31 to the associated cylinder block. Also shown in this figure are the coolant flow openings 82 formed in the cylinder head sealing surface that permit cooling water to be interchanged between the cooling jacket of the cylinder head 31 and the cooling jacket of the cylinder block. Even though the engine is water-cooled, it will be seen that the side of the cylinder head where the exhaust valves 41 lie is at a higher temperature than the side on which the intake valves 36 lie. This more highly heated area is indicated by the shaded lines in FIG. 13.

This heating of the cylinder head presents a problem, particularly in connection with light alloy cylinder head castings including those formed from aluminum alloy as noted. That is, the aluminum alloy is easily deformed by stresses above its aging temperature and has relatively low creep strength. Thus, the repeated pounding of the valves 36 and 41 against the respective valve seats 35 and 39 and particularly those on the exhaust side may cause the valve seats to sink into the cylinder head with obviously undesirable effect.

Figure 14:
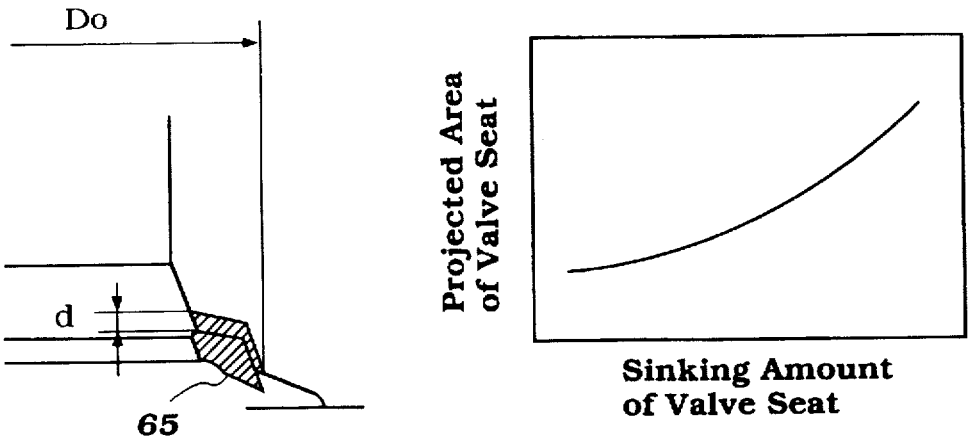
FIG. 14 is a graphical view showing on the left-hand side how the insert ring sinks into place during the installation process while the right-hand side shows the projected area of the valve seat in relation to the amount in which the valve seat insert is recessed into the cylinder head.
Figure 15:
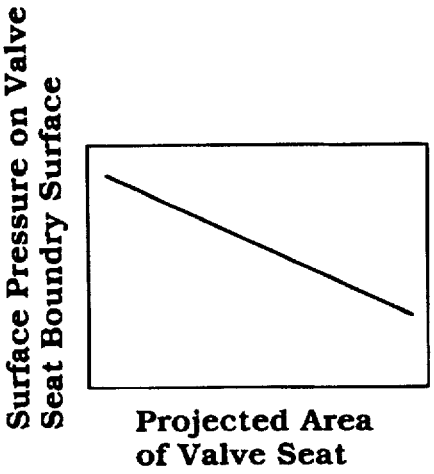
FIG. 15 is a graphical view showing how the surface pressure on the valve seat boundary surface varies in response to the projected area of the valve seat insert.

Therefore, the valve seats insert rings 65 and particularly those on the exhaust side are formed with a particular size so as to reduce the unit stresses. The left-hand side of FIG. 14 shows the effect when the insert rings 65 are pressed into place under the heated condition aforedescribed. It will be seen that the insert ring embeds itself at a depth d. As this valve seat insert is impressed its projected area $D_o$ increases as shown in the right-hand side of FIG. 14. Once the insert ring 65 is in place, however, it is desired to ensure that further embedding of the ring 65 does not occur during the running of the engine.

Therefore, and in accordance with the invention, a certain relationship is established between the diameter D of the respective valve and the diameter $D_o$ of the projected outer diameter of the insert ring 65. As may be seen in FIG. 15 as the projected area of the valve seat is increased the surface pressure that the valve exerts on the valve seat in unit stress is reduced. This would indicate that the larger the valve seat the less the likelihood of embedding during engine running will occur. However, for reasons which will later be discussed, it is desirable not to make the valve seat outer diameter too large. Also, by using such a large diameter than the spacing between the valve seat insert rings must be kept relatively large and thus minimize the total flow area.

Figure 16:
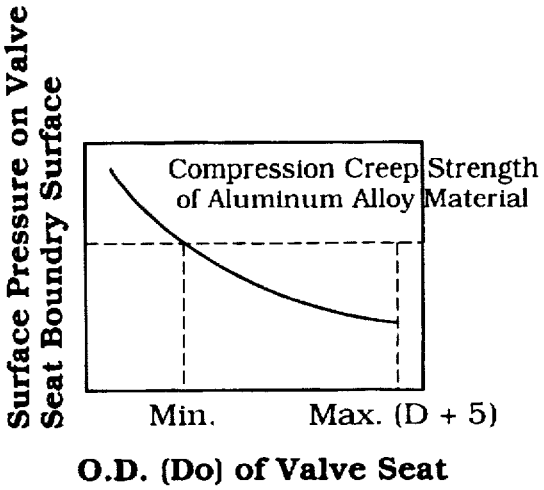
FIG. 16 is a graphical view showing how the maximum outside diameter of the valve seat varies the surface pressure on the valve seat during engine operation in relation to the creep strength of the basic cylinder head material.
Figure 17:
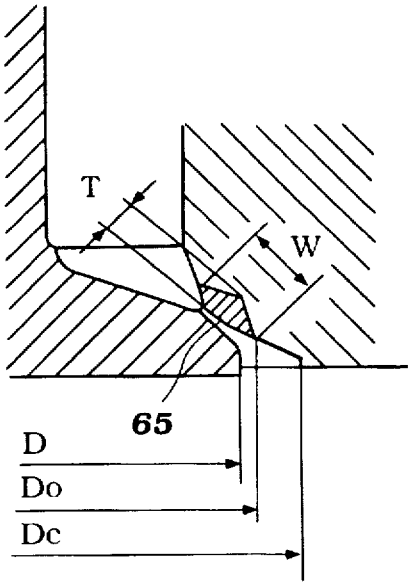
FIG. 17 is an enlarged cross-sectional view showing the valve seat area in and explains the diametric and geometric measurements of the various components in order to obtain the optimum or desired result.
Figure 18:
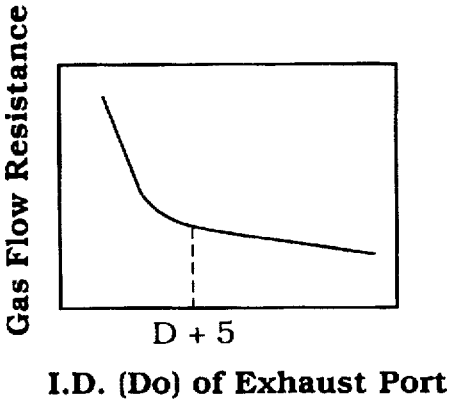
FIG. 18 is a graphical view showing the flow resistance relative to the maximum outside diameter of the flow port.

FIG. 16 is a curve showing the surface pressure on the valve seat in relation to outside diameter of the valve seat and the broken line of this curve represents the compression limit strength of the cylinder head material. Thus, by keeping the diameter greater than the minimum diameter noted in this figure, it is possible to avoid this embedding operation during running.

The minimum value for the outside diameter $D_O$of the valve seat is equal to the diameter D of the respective valve. More preferably, however, the diameter is made slightly larger but there is a practical limit as to the best diameter. As may be seen from FIGS. 17 and 18, if the outside diameter D of the valve is held constant, then increases in the diameter $D_O$ of the valve seat insert ring will reduce the flow resistance. However, as may be seen from FIG. 18, the effect of increasing the diameter $D_O$ is relatively linear up until a point and from thereon the decrease in flow resistance is rather marginal. Therefore, by choosing an outer diameter $D_O$ equal to D+5 millimeters it is possible to obtain minimum stress and optimum gas flow without necessitating a reduction in the total size of the flow passage and thus good strength, long life and low flow resistance may be obtained by utilizing a diameter $D_O$ for the outer peripheral edge of the insert ring in its final finished form which is in the range of D to D+5 where D equals the outer diameter of the valve and all dimensions are in millimeters.

Since the exhaust side is more highly stressed than the intake side, it is desirable to use the larger end of this limit for the exhaust valves while the smaller end of the limit can be utilized for the intake valves. Therefore, optimal results can be obtained by utilizing such a relationship and by utilizing a different and larger diameter relationship for the exhaust side than for the intake side.

The use of larger diameter valve seat inserts for the exhaust side than from the intake side is also facilitated by the fact that the exhaust valves 41 generally have a smaller diameter than the intake valves 36 as clearly seen in FIGS.

13 and 19. Thus, this larger valve seat diameter on the exhaust side can be utilized without any sacrifice in engine performance while at the same time obtaining the advantageous results as previously noted.

In a similar manner, the width W of the exhaust valve insert rings after finished machining is greater than the corresponding dimension of the intake valve seat inserts. In addition, the depth T of the exhaust valve insert rings after machining is also greater than that of the corresponding dimension of the insert rings associated with the intake valves 36. All of these factors increase the strength on the exhaust side above the strength on the intake side and further resist embedding of the seat insert rings during engine running. These larger dimensions are preferred on the exhaust side, as aforenoted, due to the fact that the exhaust side operates at a higher heat. In addition, this dimension also ensures against cracking or damaging of the insert ring during engine running. Furthermore, this ensures against the likelihood of the insert ring becoming displaced during engine operation.

FIG. 20 illustrates in cross section three alternative cross-sectional configurations that can be utilized for either the intake or exhaust valve seats. In the first of these embodiments, indicated at A, the angle $\alpha$ between the surfaces 70 and 75 is 30°, the angle P between the surfaces 72 and 73 is also 30° and the angle $\theta$ between the surfaces 73 and 75 is 120°. By making the angle $\theta$ 120° or larger, it is possible that maximum stress transmitted through the insert ring 65 to the base cylinder head material 32 is reduced.

The second embodiment, indicated at B, the angle $\theta$ is 150° while the angles $\alpha$ and $\beta$, are maintained at 30° and thus this embodiment has the same advantages.

FIG. C shows a third embodiment wherein a compressive force only is exerted on the joining part between the surfaces 70 and 75 so that this angle is a right angle (90°) and thus the plastic flow of aluminum alloy in this area is restricted. The angles $\beta$ and $\theta$ are 15° and 105°, respectively, in this embodiment.

In all of the embodiments as thus far described, the flow opening defined by the insert rings and specifically by the surface 70 thereof has been concentric with the finished valve seating surface, this being the machined surface shown in FIG. 11. However, there may be some advantages in some instances and providing eccentricity of the seating area and flow passage from the outer peripheral diameter of the valve seat and FIGS. 21 and 22 show such embodiments. In this embodiment, it will be seen that the center passages indicated at 101 of the exhaust valve seats indicated at $O_a$ is offset from the outer diameter $O_b$ of the outer peripheral edges of these seats by a distance x. As a result, the actual flow openings are spaced further from the cylinder bore axis B than the peripheral edges of the valve seat inserts. In a like manner, the intake valve seats are also offset away from the cylinder bore axis B. This provides a greater valve seat area where the intake and exhaust valves are adjacent to each other and thus the pressures applied to the cylinder head through the seating areas of the valves is spaced further from each other and the temperature gradient is reduced.

FIG. 23 shows another series of embodiments wherein plastic flow deformation of the valve seat insert into the cylinder head during running is reduced by providing raised stripes or ribs 102 around the insert ring 65 either at the lower peripheral edge or at an intermediate location or by providing plural ridges 103 as shown in the lower views. These ridges prevent plastic flow of the aluminum allow in a shearing direction and hence preclude the insert ring 65 from being pounded down into the cylinder head during running operation of the engine.

FIG. 24 shows another series of embodiments wherein the bond area between the insert ring 65 and the cylinder head material 32 is altered so as to improve the strength. In the first of these embodiments A, the eutectic alloy is retained in the area 150 during the resistance heating method by controlling the amount of heat and pressure so that it is not totally extruded. Thus, the area 150 has a higher strength than the aluminum alloy of the base cylinder head material and resistance against deformation and the creep strength is increased. It has been previously noted that a copper coating is employed for forming eutectic alloy. However, the coating may be a plating of either zinc, tin, gold or an aluminum silicon alloy. FIGS. B and C show other embodiments wherein the impregnating material is defused into the aluminum alloy to provide hardened solid solution texture layers 152 or 151 in this area. The layer 152 is diffused at different depths, while the layer 151 is uniform. Again, this restricts the plastic flow in the sheering direction of the joining portion.

FIG. 25D shows a finer texture layer 153 formed by the joining portion and FIG. 25E shows a layer 154 which is a deposited reinforced texture layer caused by utilizing the coating to metal diffuse and form solidify ions of iron or nickel in the mixture.

FIG. 25F shows a way in which a composite texture layer 155 is formed by dispersing metallic particles and fibers in the texture. This compound deposits grains boundary slip in the texture which may be restricted by causing the compound to deposit on the crystal grain boundary.

FIGS. 25G, H and I show the use of flange portions 160 and/or 161 formed on the entire circumference of the valve seat insert ring 65 so that the projected area of the valve seat insert increases and the surface pressure due to compression forces is reduced.

In addition to these embodiments, plastic flow of the aluminum alloy around the joining area may be restricted or controlled by making a surface roughness on either the insert ring or the aluminum alloy having a surface roughness RA in the range of 10 or greater. Also, strontium may be utilized as a alloying material in the aluminum of the base casting 32 so as to improve the creep strength.

Therefore, it should be apparent from the foregoing description that the described embodiments of the invention provide very effective good cylinder heads having valve seats that will not creep into the base material even when utilized on the exhaust side. Of course, the foregoing description it should be readily apparent that the described pressing and bonding methods provide very effective valve seats that will eliminate sacrifices in strength and port configuration over conventional methods. In addition, because of better heat transfer, lighter weight valves can be utilized and larger valve areas can be employed so as to increase the performance of the engine without shortening its life. Of course, the foregoing description is that of the preferred embodiment of the invention, and various changes and modifications may be made without departing from the spirit and scope of the invention, as defined by the appended claims.

What is claimed is:

1. A cylinder head for a reciprocating machine comprised of a base metal casting formed from a lightweight metal and having a flow passage extending from a portion of said base cylinder head member that cooperates with a cylinder bore for forming a variable volume chamber, a valve seat insert metallurgically bonded to said base cylinder head material at the variable volume chamber end of said flow passage, said metallurgical bond being formed by a metallurgical bonding directly between the materials of said base cylinder head member and said valve seat insert, said valve seat insert being formed from a harder material than that of said base cylinder head member and forming a valve seat, a poppet-type valve supported for reciprocation relative to said valve seat surface for opening and closing the flow through said passage, and wherein the following relationship holds:

$D<D_o<D+5$ where $D_o$ is the outside diameter of said valve seat insert, D is the outside diameter of said valve and D and 5 are in millimeters.

2. A cylinder head for a reciprocating machine comprised of a base metal casting formed from a lightweight metal and having a flow passage extending from a portion of said base cylinder head member that cooperates with a cylinder bore for forming a variable volume chamber, a valve seat insert metallurgically bonded to said base cylinder head material at the variable volume chamber end of said flow passage, said valve seat insert being formed from a harder material than that of said base cylinder head member and forming a valve seat surface, and a poppet-type valve supported for reciprocation relative to said valve seat surface for opening and closing the flow through said passage, the effective flow passage defined by the inner diameter of said valve seat insert and said valve seat surface being eccentrically disposed relative to the outer diameter of said valve seat insert so that said valve seat insert has a different thickness around its circumference.

3. A cylinder head as set forth in claim 2 wherein the following relationship holds:

$D<D_0<D+5$ where $D_0$ is the outside diameter of said valve seat insert, D is the outside diameter of said valve and D and 5 are in millimeters.

4. A cylinder head for an internal combustion engine comprised of a base cylinder head member formed from a lightweight metal alloy, an intake flow passage extending through said base cylinder head member and terminating in a surface that cooperates with an associated cylinder bore for forming a combustion chamber, an exhaust passage extending through said base cylinder head member from said surface for forming an exhaust gas flow path from said combustion chamber, an intake valve seat insert and an exhaust valve seat insert each metallurgically bonded to the portion of said intake and exhaust passages terminating in said surface for forming intake and exhaust valve seats therein, said metallurgical bond being formed by a metallurgical bonding directly between the materials of said base cylinder head member and said valve seat insert, said exhaust valve seat insert being configured so as to provide a lower unit stress through its cooperation with the exhaust valve than said intake seat insert with its associated intake valve.

5. A cylinder head as set forth in claim 4, wherein in the width of the exhaust valve seat insert is greater than that of the intake valve seat insert in relation to its diameter.

6. A cylinder head as set forth in claim 5 wherein the following relationship holds for each valve seat insert:

$D<D_0<D+5$ where $D_0$ is the outside diameter of said valve seat insert, D is the outside diameter of said valve and D and 5 are in millimeters.

7. A cylinder head as set forth in claim 4 wherein the inner diameter of said valve seat inserts is eccentrically exposed relative to the outer diameter of said valve seat inserts so that said valve seat inserts have a different thickness around their circumference.

8. A cylinder head as set forth in claim 4, wherein the thickness of the exhaust valve seat insert in a direction normal to its valve seating surface is greater than that of the intake valve seat insert.

9. A cylinder head as set forth in claim 7, wherein in the width of the exhaust valve seat insert is greater than that of the intake valve seat insert in relation to its diameter.

10. A cylinder head as set forth in claim 7 wherein the following relationship holds for each valve seat insert:

$D<D_o<D+5$ where $D_o$ is the outside diameter of said valve seat insert, D is the outside diameter of said valve and D and 5 are in millimeters.

11. A cylinder head as set forth in claim 4, wherein the height of the exhaust valve seat insert in the direction of its flow path is greater than that of the intake valve seat insert.

12. A cylinder head as set forth in claim 11, wherein in the width of the exhaust valve seat insert is greater than that of the intake valve seat insert in relation to its diameter.

13. A cylinder head as set forth in claim 11 wherein the following relationship holds for each valve seat insert:

$D<D_o<D+5$ where $D_o$ is the outside diameter of said valve seat insert, D is the outside diameter of said valve and D and 5 are in millimeters.

14. A cylinder head as set forth in claim 4 wherein there are two intake valve seats on one side of the cylinder head surface and two exhaust valve seats on the other side of said surface.

15. A cylinder head as set forth in claim 14, wherein in the width of the exhaust valve seat inserts is greater than that of the intake valve seat inserts in relation to their diameters.

16. A cylinder head as set forth in claim 15 wherein the following relationship holds for each valve seat insert:

$D<D_o<D+5$ where $D_o$ is the outside diameter of said valve seat insert, D is the outside diameter of said valve and D and 5 are in millimeters.

17. A cylinder head as set forth in claim 14 wherein the inner diameter of said valve seat inserts is eccentrically exposed relative to the outer diameter of said valve seat inserts so that said valve seat inserts have a different thickness around their circumference.

18. A cylinder head as set forth in claim 14, wherein the thickness of the exhaust valve seat inserts in a direction normal to its valve seating surface is greater than that of the intake valve seat inserts.

19. A cylinder head as set forth in claim 17, wherein in the width of the exhaust valve seat inserts is greater than that of the intake valve seat inserts in relation to their diameters.

20. A cylinder head as set forth in claim 17 wherein the following relationship holds for each valve seat insert:

$D<D_o<D+5$ where $D_o$ is the outside diameter of said valve seat insert, D is the outside diameter of said valve and D and 5 are in millimeters.

21. A cylinder head as set forth in claim 14, wherein the height of the exhaust valve seat inserts in the direction of its flow path is greater than that of the intake valve seat insert.

22. A cylinder head as set forth in claim 21, wherein in the width of the exhaust valve seat inserts is greater than that of the intake valve seat inserts in relation to their diameters.

23. A cylinder head as set forth in claim 21 wherein the following relationship holds for each valve seat insert:

$D<D_o<D+5$ where $D_o$ is the outside diameter of said valve seat insert, D is the outside diameter of said valve and D and 5 are in millimeters.

* * * * *